US010056189B2

(12) United States Patent
Xu et al.

(10) Patent No.: US 10,056,189 B2
(45) Date of Patent: Aug. 21, 2018

(54) HIGH VOLTAGE WIRE LEADING METHOD FOR STEREOSCOPIC WOUND CORE OPEN VENTILATED DRY-TYPE TRANSFORMER

(71) Applicant: Haihong Electric Co., Ltd., Kaiping (CN)

(72) Inventors: Kaixuan Xu, Kaiping (CN); Xianqing Guo, Kaiping (CN); Qingning Liang, Kaiping (CN); Liqiong Long, Kaiping (CN)

(73) Assignee: HAIHONG ELECTRIC CO., LTD., Kaiping (CN)

( * ) Notice: Subject to any disclaimer, the term of this patent is extended or adjusted under 35 U.S.C. 154(b) by 233 days.

(21) Appl. No.: 14/526,990

(22) Filed: Oct. 29, 2014

(65) Prior Publication Data

US 2016/0055970 A1 Feb. 25, 2016

(30) Foreign Application Priority Data

Aug. 22, 2014 (CN) ..... 2014 1 0419491

(51) Int. Cl.

| | |
|---|---|
| ***H01F 30/12*** | (2006.01) |
| ***H01F 41/10*** | (2006.01) |
| ***H01F 41/02*** | (2006.01) |
| ***H01F 41/06*** | (2016.01) |
| ***H01F 5/04*** | (2006.01) |

(52) U.S. Cl.

CPC ..... *H01F 41/10* (2013.01); *H01F 5/04* (2013.01); *H01F 41/0206* (2013.01); *H01F 41/06* (2013.01); *H01F 30/12* (2013.01)

(58) Field of Classification Search

CPC ..... H01F 30/12; H01F 41/0206; H01F 41/06; H01F 41/10; H01F 5/04

See application file for complete search history.

(56) References Cited

U.S. PATENT DOCUMENTS 4,639,705 A * 1/1987 Beisser ..... H01F 41/02 336/196
4,965,712 A * 10/1990 Duspiva ..... H01F 30/10 336/175
2004/0145445 A1* 7/2004 Yang ..... H01F 27/2804 336/223

(Continued)

*Primary Examiner* — Minh Trinh
(74) *Attorney, Agent, or Firm* — King & Schickli, PLLC

(57) ABSTRACT

The invention discloses a high voltage wire leading method for a stereoscopic wound core open ventilated dry-type transformer, which comprises the steps of fixing stereoscopic wound cores arranged in a triangular shape between an upper clamp and a lower clamp, winding A, B and C three phase coils on the stereoscopic wound cores and arranging a high voltage wire leading bracket on the upper clamp, wherein the high voltage wire leading bracket is provided with connecting terminals which respectively correspond to the A, B and C three phase coils; and each phase coil is respectively provided with a wire inlet terminal and a wire outlet terminal. In the high voltage wire leading method, each of the three A, B, and C phase coils is provided with two wire outlet terminals and the numbers of turns of the three phase coils are still equal, so that under the condition of not changing the numbers of the turns of the coils, the added wire outlet terminals make leading more conveniently and the lead structure simpler.

4 Claims, 3 Drawing Sheets

(56) References Cited

U.S. PATENT DOCUMENTS

| | | | | |
|---|---|---|---|---|
| 2006/0097837 | A1* | 5/2006 | Yamasaki | H01F 30/06 336/208 |
| 2012/0139678 | A1* | 6/2012 | Outten | H01F 41/08 336/5 |
| 2013/0106546 | A1* | 5/2013 | Outten | H01F 27/02 336/5 |
| 2016/0005536 | A1* | 1/2016 | Nowak | H01F 27/245 29/606 |

* cited by examiner

HIGH VOLTAGE WIRE LEADING METHOD FOR STEREOSCOPIC WOUND CORE OPEN VENTILATED DRY-TYPE TRANSFORMER

CROSS-REFERENCE TO RELATED APPLICATIONS

This Application claims priority to Application 201410419491.3 filed on Aug. 22, 2014 in China.

BACKGROUND

The invention relates to a wire leading technology of a transformer coil, in particular to a high voltage wire leading method for a stereoscopic wound core open ventilated dry-type transformer.

High voltage leads of existing stereoscopic wound core open-type transformer need to be led to the side of clamp in order to bring convenience to user for wiring; however, three phases of coils are arranged in a triangular shape and outgoing lines are not on the same level, resulting in complex wire leading process, in which a necessary insulation distance between the leads may increase the integral outline size of the transformer, and resulting in numerous bending of the leads which are difficult to fix.

SUMMARY OF THE INVENTION

To solve the technical problems above, the invention provides a high voltage wire leading method for a stereoscopic wound core open ventilated dry-type transformer. The high voltage wire leading method enables corresponding wire outlet terminals to be led out of different surfaces of a high voltage coil and makes the lead structure simpler, aesthetical and easy to connect.

To fulfill the objectives, the invention adopts the following technical scheme:

The high voltage wire leading method for the stereoscopic wound core open ventilated dry-type transformer comprises the steps of fixing stereoscopic wound cores arranged in a triangular shape between an upper clamp and a lower clamp, winding A, B and C three phase coils around the stereoscopic wound cores and arranging a high voltage wire leading bracket on the upper clamp, wherein the high voltage wire leading bracket is provided with connecting terminals which respectively correspond to the A, B and C three phase coils; each phase coil is provided with a wire inlet terminal, respectively as 11, 21, 31, and each phase coil is provided with two wire outlet terminals, respectively as 12 and 13, 22 and 23, 32 and 33, characterized in that:

After the winding of the A phase coil is completed, the wire outlet terminal 12 of the A phase coil is connected to the A phase connecting terminal; an outgoing line is led out of the A phase wire outlet terminal and is wound by an angle to form an A phase second wire outlet terminal 13 and the A phase second wire outlet terminal 13 is close to the C phase wire inlet terminal 31 and is connected to the C phase wire inlet terminal 31;

After the winding of the B phase coil is completed, the wire outlet terminal 22 of the B phase coil is connected to the B phase connecting terminal; an outgoing line is led out of the B phase wire outlet terminal and is wound by an angle to form a B phase second wire outlet terminal 23 and the B phase second wire outlet terminal 23 is close to the A phase wire inlet terminal 11 and is connected to the A phase wire inlet terminal 11; and After the winding of the C phase coil is completed, the wire outlet terminal 31 of the C phase coil is connected to the C phase connecting terminal; an outgoing line is led out of the C phase wire outlet terminal and is wound by an angle to form a C phase second wire outlet terminal 33 and the C phase second wire outlet terminal 33 is close to the B phase wire inlet terminal 21 and is connected to the B phase wire inlet terminal 21;

By adopting the high voltage wire leading method, two wire outlet terminals are led out of each of the A, B and C three phase coils, and the numbers of turns of the three phase coils are still equal, so that under the condition of not changing the numbers of the turns of the coils, the added wire outlet terminals make leading more conveniently, the wire leading more easily and the lead structure simpler.

Preferably, winding the outgoing line led out of the A phase second wire outlet terminal 13 with respect to the A phase wire outlet terminal 12 is by an angle of 145 degrees to 155 degrees.

Preferably, winding the outgoing line led out of the B phase second wire outlet terminal 23 with respect to the B phase wire outlet terminal 22 is by an angle of 55 degrees to 65 degrees.

Preferably, winding the outgoing line led out of the C phase second wire outlet terminal 33 is with respect to the C phase wire outlet terminal 32 is by the angle of 5 degrees to 15 degrees.

The invention has the beneficial effects that by adopting the high voltage wire leading method, the wire outlet terminals of the stereoscopic wound core coils which are of a triangular structure can be ingeniously arranged to be connected to the wire outlet terminals, so connecting distances between the leads in the three phase coils are shortened, arrangement of the leads is simplified, materials are reduced, each leads are in a simple structure and the problem of complexity of wire leading of the stereoscopic wound core open-type transformer is solved.

BRIEF DESCRIPTION OF DRAWINGS

The embodiments of the invention are further described by combining the accompanying drawings.

DETAILED DESCRIPTION

Figure 1:
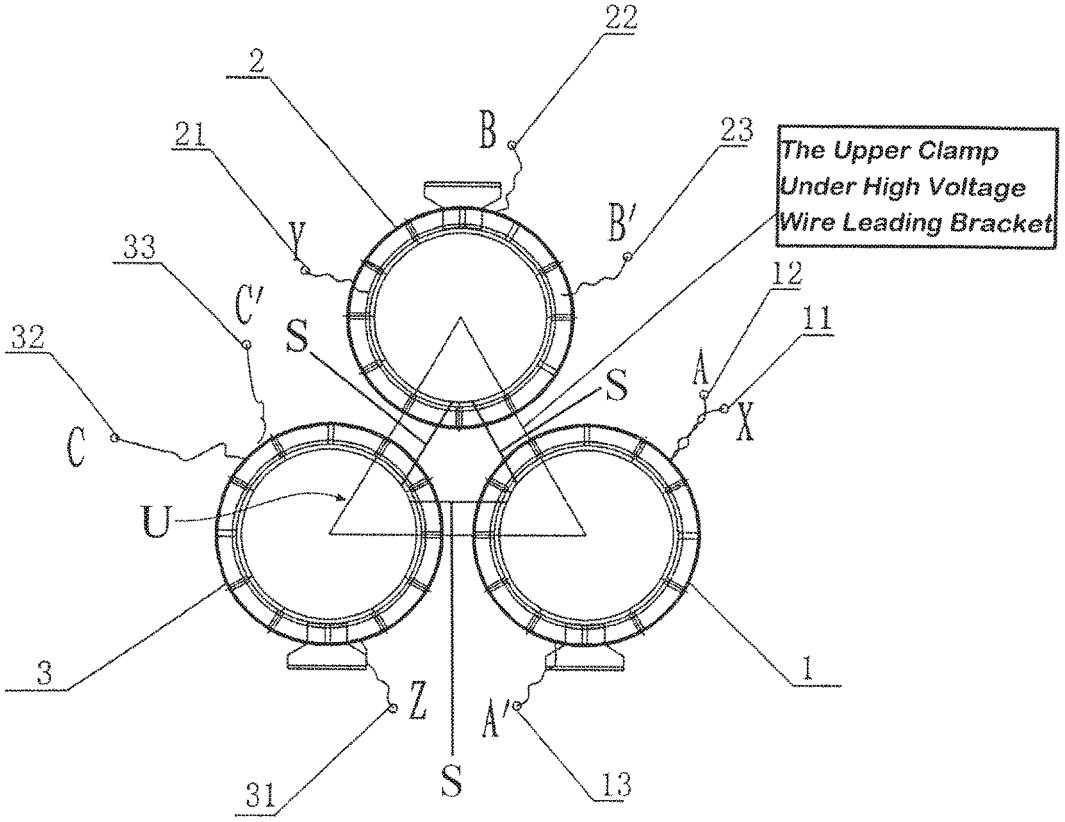
FIG. 1 is a structural diagram of three phase coils of the invention.

A high voltage wire leading method for a stereoscopic wound core open ventilated dry-type transformer, which is provided by the invention, comprises the steps: firstly, fixing stereoscopic wound cores S (see, e.g., FIG. 1) arranged in a triangular shape between an upper clamp U (see, e.g., FIG. 1) and a lower clamp L (see, e.g., FIG. 3), then, winding A, B and C three phase coils around the stereoscopic wound cores S and arranging a high voltage wire leading bracket on the upper clamp, wherein, as see in FIG. 1, the high voltage wire leading bracket is provided with connecting terminals which respectively correspond to the A, B and C three phase coils. The connecting terminals respectively are an A phase connecting terminal, a B phase connecting terminal and a C phase connecting terminal. And each phase coil is respectively provided with a wire inlet terminal and a wire outlet terminal.

Figure 2:
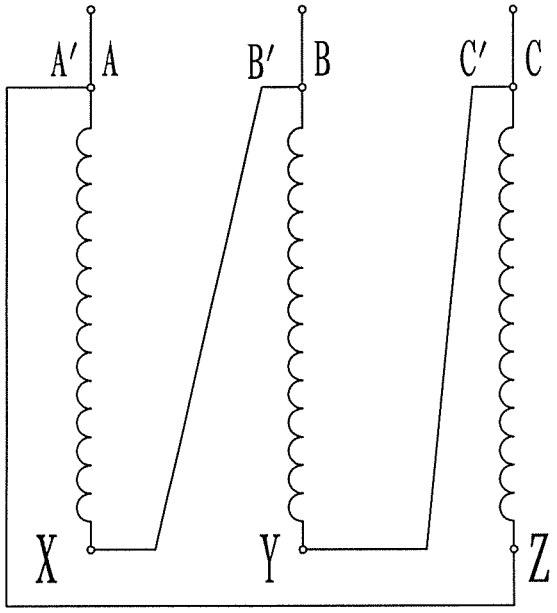
FIG. 2 is a schematic diagram of connection in the invention.
Figure 3:
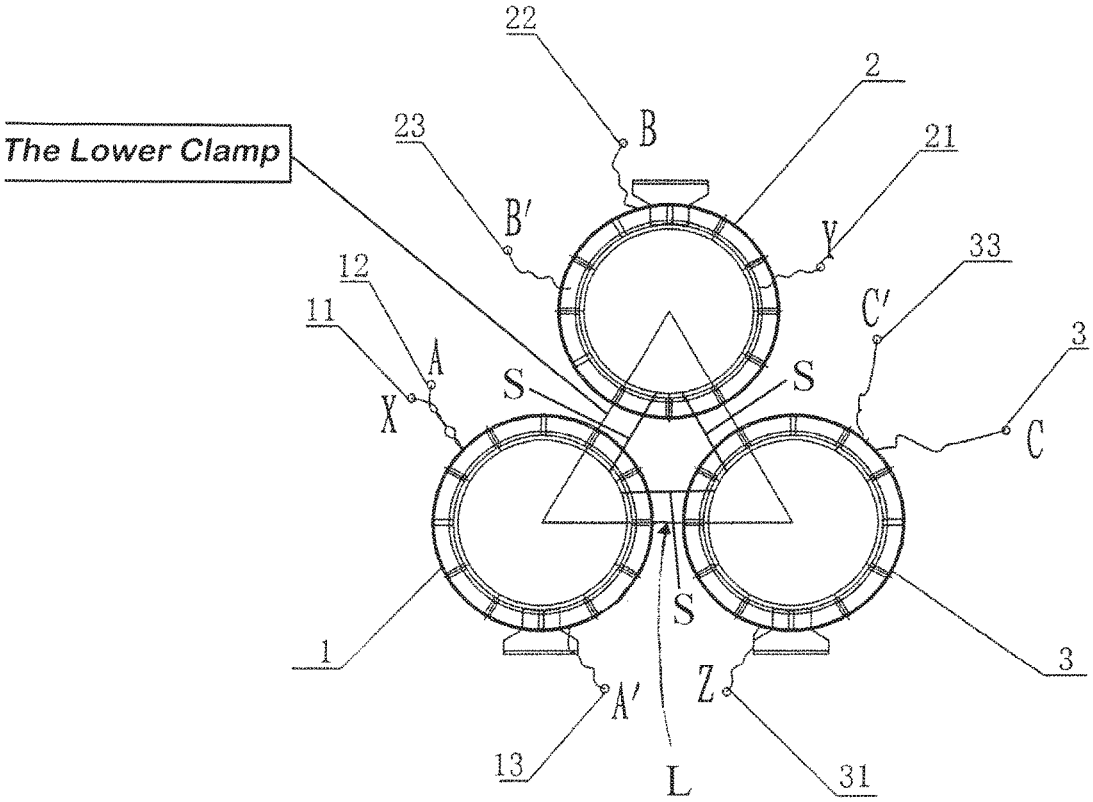
FIG. 3 is a bottom view of FIG. 1.

With reference to FIG. 1, FIG. 2 and FIG. 3, in the embodiment, the positions of X, A and A' in the accompanying drawings respectively represent the A phase wire inlet terminal 11, the A phase wire outlet terminal 12 and the A phase second wire outlet terminal 13 which correspond to the A phase coil 1; the positions of Y, B and B' in the accompanying drawings respectively represent the B phase wire inlet terminal 21, the B phase wire outlet terminal 22 and the B phase second wire outlet terminal 23 which correspond to the B phase coil 2. The positions of Z, C and C' in the accompanying drawings respectively represent the C phase wire inlet terminal 31, the C phase wire outlet terminal 32 and the C phase second wire outlet terminal 33 which correspond to the C phase coil 3; after the winding of the A phase coil 1 is completed, the wire outlet terminal 12 of the A phase coil 1 is connected to the A phase connecting terminal, another outgoing line is led out of the A phase wire outlet terminal 12 and is wound by an angle of 150 degrees to form the A phase second wire outlet terminal 13, i.e. the position of A', and the A phase second wire outlet terminal 13 is close to the C phase wire inlet terminal 31 and is connected to the C phase wire inlet terminal 31; after the winding of the B phase coil 2 is completed, the wire outlet terminal 22 of the B phase coil 2 is connected to the B phase connecting terminal, an outgoing line is led out of the B phase wire outlet terminal 22 and is wound more by an angle of 60 degrees to form the B phase second wire outlet terminal 23, i.e. the position of B', and the B phase second wire outlet terminal 23 is close to the A phase wire inlet terminal 11 and is connected to the A phase wire inlet terminal 12; after the winding of the C phase coil 3 is completed, the wire outlet terminal 32 of the C phase coil 3 is connected to the C phase connecting terminal, an outgoing line is led out of the C phase wire outlet terminal 32 and is wound more by an angle of 10 degrees to form the C phase second wire outlet terminal 33, i.e. the position of C', the C phase second wire outlet terminal is close to the B phase wire inlet terminal 21 and is connected to the B phase wire inlet terminal 21. The lead structure is formed by connecting A' to Z, connecting B' to X and connecting C' to Y, so the arrangement of leads is simplified, and the schematic diagram of connection is shown in FIG. 2.

By adopting the high voltage wire leading method, two wire outlet terminals are led out of each of the A, B and C three phase coils and the numbers of turns of the three phase coils are still equal, so that under the condition of not changing the numbers of the turns of the coils, the added wire outlet terminals make the wire leading more conveniently and the lead structure simpler.

The above is only the preferred embodiments of the invention. The invention is not limited to the structure of the embodiments and any conditions for implementing the technical effects of the invention by the same means shall belong to the scope of protection of the invention.

What is claimed is:

1. A high voltage wire leading method for a stereoscopic wound core S open ventilated dry-type transformer, comprising the following steps:

fixing the stereoscopic wound core S in a triangular shape between an upper clamp and a lower clamp;

winding A, B and C three phase coils around the stereoscopic wound core S;

arranging a high voltage wire leading bracket on the upper clamp, the high voltage wire leading bracket including connecting terminals, said connecting terminals including an A phase connecting terminal, a B phase connecting terminal and a C phase connecting terminal, which respectively correspond and are connected to the winding A, B and C three phase coils; and providing each of the three phase coils with a wire inlet terminal and a wire outlet terminal;

wherein fixing the stereoscopic wound core S in the triangular shape between the upper clamp and the lower clamp further comprises steps of:

after providing of the upper and lower clamps, forming the wire inlet and outlet terminals, and the winding of the A phase coil is completed, leading the wire outlet terminal of the A phase coil to the A phase connecting terminal to an outgoing line out of the A phase wire outlet terminal and winding the outgoing line by an angle to form an A phase second wire outlet terminal, and connecting the A phase second wire outlet terminal to the C phase wire inlet terminal;

after the winding of the B phase coil is completed, leading the wire outlet terminal of the B phase coil to the B phase connecting terminal, leading an outgoing line out of the B phase wire outlet terminal and winding the outgoing line by an angle to form a B phase second wire outlet terminal, and connecting the B phase second wire outlet terminal to the A phase wire inlet terminal; and after the winding of the C phase coil is completed, leading the wire outlet terminal of the C phase coil to tdafadsfashe C phase connecting terminal, leading an outgoing line out of the C phase wire outlet terminal and winding the outgoing line more by an angle to form a C phase second wire outlet terminal, and connecting the C phase second wire outlet terminal to the B phase wire inlet terminal.

2. The high voltage wire leading method for a stereoscopic wound core S open ventilated dry-type transformer according to claim 1, wherein winding the outgoing wire led out of the A phase second wire outlet terminal with respect to the A_phase wire outlet terminal is at an angle of 145 degrees to 155 degrees.

3. The high voltage wire leading method for a stereoscopic wound core S open ventilated dry-type transformer according to claim 2, wherein winding the outgoing wire led out of the B phase second wire outlet terminal with respect to the B phase wire outlet terminal is at an angle of 55 degrees to 65 degrees.

4. The high voltage wire leading method for a stereoscopic wound core S open ventilated dry-type transformer according to claim 3, wherein winding the outgoing wire led out of the C phase second wire outlet terminal with respect to the C phase wire outlet terminal is at an angle of 5 degrees to 15 degrees.

* * * * *